United States Patent [19]

Becka et al.

[11] 4,433,632

[45] Feb. 28, 1984

[54] TRANSFERRING SUCCESSIVE WORKPIECES TO AND FROM A WORK STATION

[75] Inventors: Michael M. Becka, Nashua; George Bennett, Milford, both of N.H.

[73] Assignee: International Shoe Machine Corporation, Nashua, N.H.

[21] Appl. No.: 316,017

[22] Filed: Oct. 28, 1981

[51] Int. Cl.[3] ..... D05B 97/00; D05B 21/00; D05B 1/00

[52] U.S. Cl. ..... 112/262.3; 112/121.12

[58] Field of Search ..... 112/121.12, 121.15, 112/121.11, 121.29, 121.14, 262.3, 262.1, 266.1

[56] References Cited

U.S. PATENT DOCUMENTS

| | | | |
|---|---|---|---|
| 3,170,423 | 2/1965 | Henebry | 112/121.12 |
| 3,208,415 | 9/1965 | Reeber | 112/121.12 |
| 3,385,244 | 5/1968 | Ramsey et al. | 112/121.12 |
| 3,459,144 | 8/1969 | Ramsey et al. | 112/121.11 |
| 3,474,747 | 10/1969 | Noiles | 112/121.12 |
| 3,695,765 | 10/1972 | Bernewasser | 112/121.12 |
| 3,974,786 | 8/1976 | Bianchi | 112/121.12 |
| 4,069,778 | 1/1978 | Kozawa | 112/121.12 |
| 4,089,279 | 5/1978 | Hess et al. | 112/121.12 |

*Primary Examiner*—H. Hampton Hunter

[57] ABSTRACT

For use with a sewing machine (10) that sews a predetermined pattern of stitches on workpieces (22) of successive workpiece assemblies formed of workpiece mounts (24) having the workpieces (22) detachably secured thereto while the workpiece assemblies are being moved in a path corresponding to the predetermined pattern past a work station that includes the needle (16) of the sewing machine, a workpiece handling means that enables the workpiece to be presented to the work station and removed from the station successively and alternately from the opposite sides of the work station.

3 Claims, 5 Drawing Figures

TRANSFERRING SUCCESSIVE WORKPIECES TO AND FROM A WORK STATION

BACKGROUND OF THE INVENTION

U.S. Pat. Nos. 3,208,415 and 3,385,244 are illustrative of prior art machines that comprise: a work station that includes an operating instrumentality actuable to perform work on succesive workpiece assemblies that are each formed of a workpiece mount having a workpiece detachably secured thereto; and shifting means so constructed as to be actuable to shift a workpiece assembly in a prone plane on a prescribed path past the work station while operating instrumentality is actuated to perform a pattern of work on the workpiece that corresponds to said prescribed path. In these types of machines, an individual workpiece assembly must be attached to the shifting means and then removed from the shifting means before the succeeding workpiece assembly can be attached to and then removed from the shifting means. This causes a delay in the presentation of succesive workpiece assemblies to the machine, particularly when an operator is servicing a plurality of the machines.

SUMMARY OF THE INVENTION

The principle object of this invention is to provide a system for presenting successive workpiece assemblies to the machine and withdrawing successive workpiece assemblies from the machine in such a manner as to diminish the time between operations of the machine on succeeding workpieces and as to enable the operator to more efficiently handle a plurality of the machines. This is accomplished by providing an elevating mechanism on each side of the work station that is movable between upper and lower positions. When both the first and the second elevating mechanisms are in their upper positions, a first and a second workpiece assembly are respectively retained on them. The first elevating mechanism is then lowered to its lower position in position to enable the first workpiece assembly to be transferred to the shifting means. The shifting means then moves the first workpiece assembly in such a path as to enable the pattern of work to be performed thereon and then return to the position where the first workpiece assembly was transferred to the shifting means from the first elevating mechanism. The first workpiece assembly is then transferred to the first elevating mechanism and the first elevating mechanism is raised to its upper position where the first workpiece assembly is released from the first elevating mechanism and a third workpiece assembly may be retained on the first elevating mechanism. After the first elevating mechanism has commenced to return to its upper position, the second elevating mechanism, the second workpiece assembly and the shifting means repeat the steps and the relative movements referred to above with respect to the first elevating mechanism and the first workpiece assembly.

While the work performed on the workpieces is disclosed in this illustrative embodiment of the invention as being a stitching operation, it is within the purview of the invention to present and withdraw workpieces from machines that perform other work, such as drilling holes, in the workpieces.

DESCRIPTION OF THE PREFERRED EMBODIMENT

Figure 1:
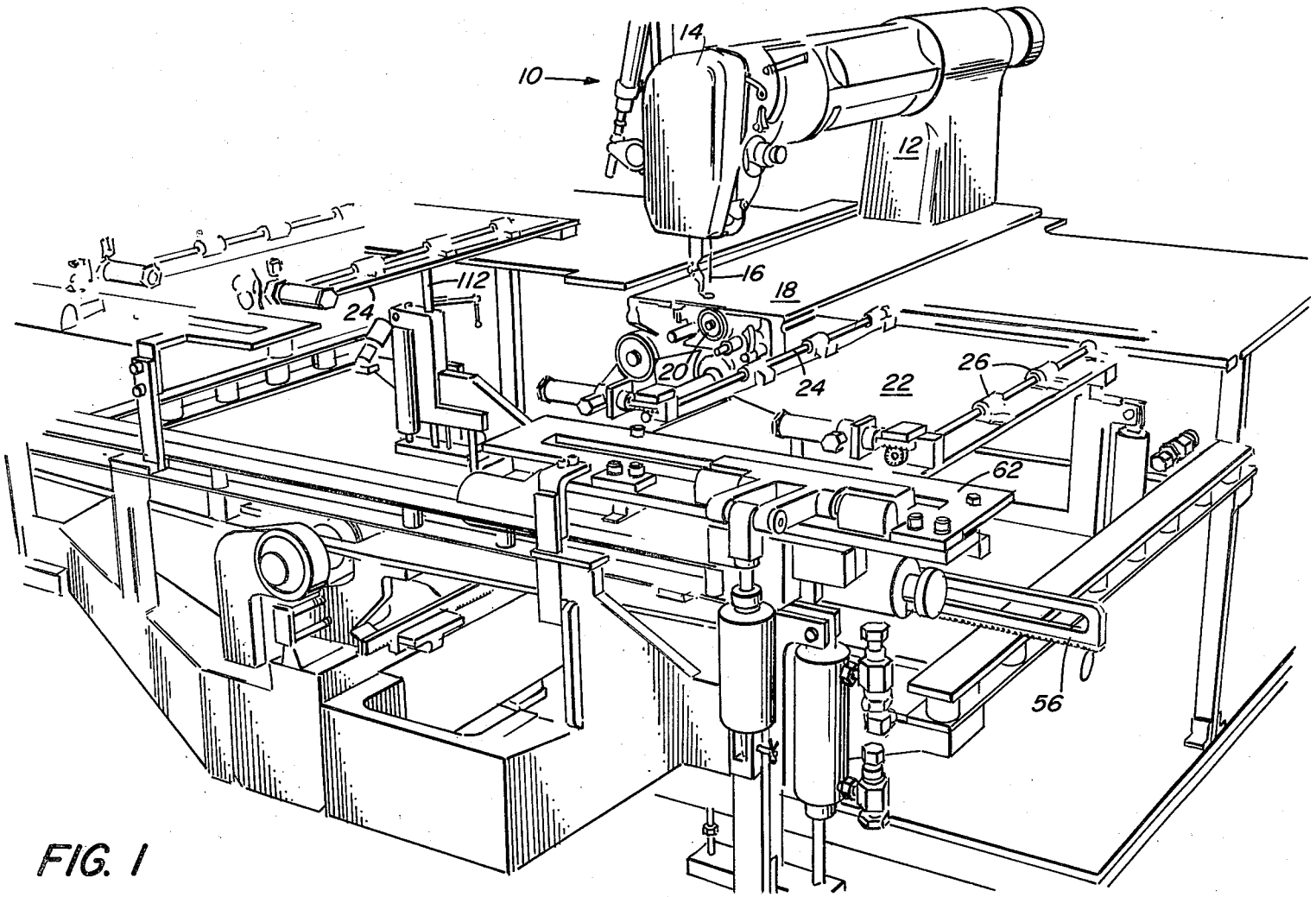
FIG. 1 is an isometric view of the machine.

FIG. 1 shows the sewing mechanism 10 which is anchored to a support 12 and has a head 14 at its front end in which a needle 16 is reciprocably mounted. A conventional drive mechanism within the head 14 is actuable to vertically reciprocate the needle 16 into and out of an opening in a throat plate 18 with the needle cooperating with a bobbin assembly 20 located below the throat plate 18 to form stitches in a workpiece 22. The sewing mechanism, as so far described, is a Pfaff sewing machine model 483-798/01, manufactured in the Federal Republic of Germany and distributed in the United States by Cohen Shoe Machinery Company, Inc. located at 35 Congress Street, Salem, Mass., 01970.

A hollow frame 24 having spaced sides is located on each side of the sewing mechanism, with each frame 24 having clamps 26 along its sides adapted to hold a workpiece 22.

An X-Y drive mechanism is provided to intermittently shift a selected frame 24 in X and Y directions that respectively extend transversely and longitudinally of the sewing mechanism 10 so that the reciprocating needle 16 can penetrate the workpiece 22 and rise above the workpiece while the workpiece is stationary and again penetrate the workpiece after the workpiece has shifted to thereby form decorative stitches in a predetermined pattern in the workpiece which is in the form of a shoe upper. Such drive mechanisms are well known as illustrated by U.S. Pat. Nos. 3,208,415 and 3,385,244. The shifting of the selected frame 24 along the X and Y axes is caused, similarly to the manner shown in U.S. Pat. No. 3,385,244, by a tape that emits signals to a computer that effects the shifting of the frame 24.

Figure 2:
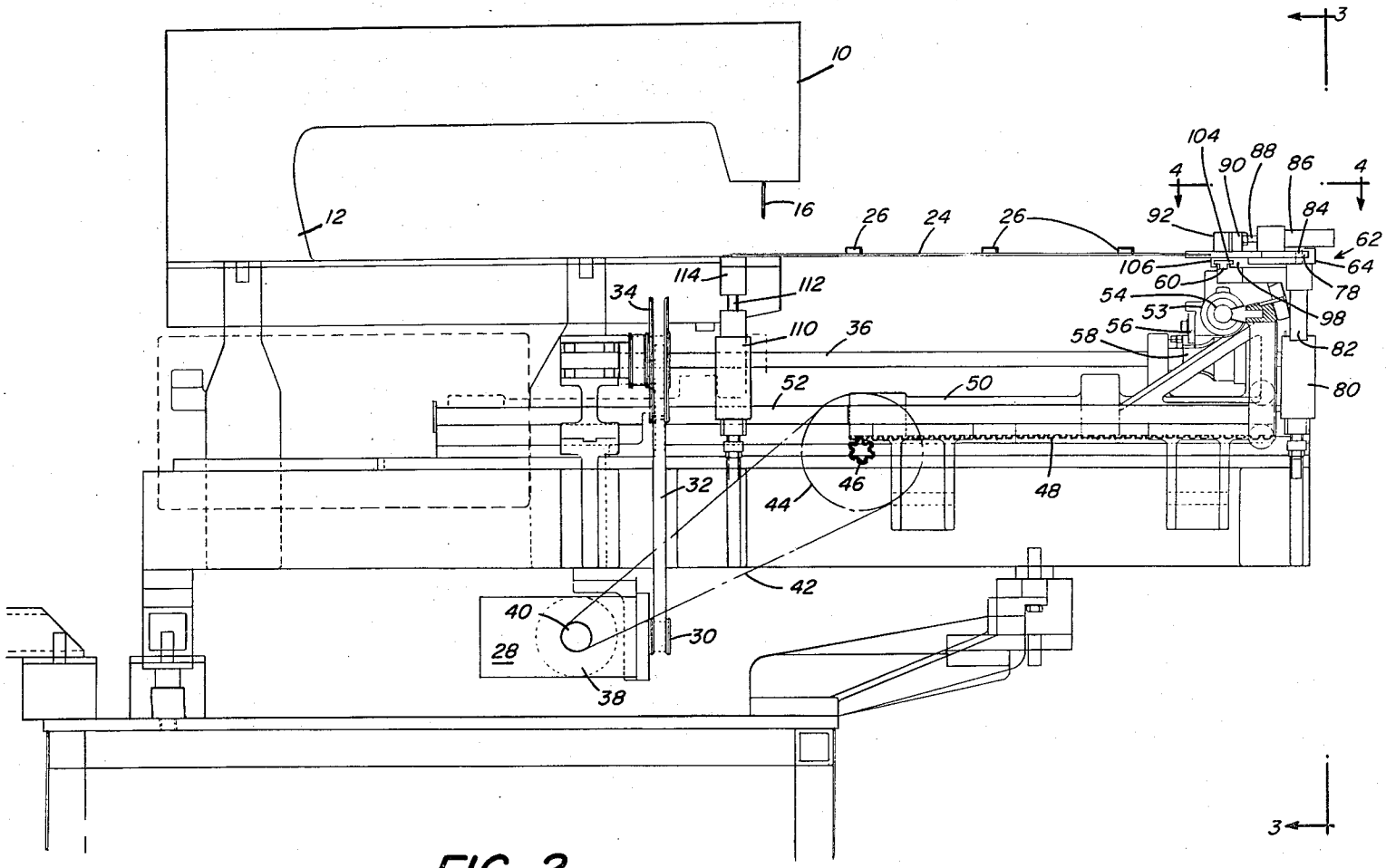
FIG. 2 is a side elevation of the machine.

The X-Y drive mechanism of this invention is shown in FIG. 2. This mechanism comprises a reversible motor 28 whose driven shaft is connected via a pulley 30, a belt 32, and a pulley 34 to a shaft 36 whereby rotation of the motor 28 in one direction or the other will rotate the shaft 36 in a corresponding direction. The shaft 36 has splines running along its length for a reason given below. A reversible motor 38 is connected via a pulley 40, a belt 42, and a pulley 44 to a rotatably mounted pinion 46. The pinion 46 is in mesh with a rack 48 at the bottom of a frame 50. The frame 50 is slidably mounted for movement on a bar 52 whose axis is parallel to the Y axis. Connected to the frame 50 for movement therewith in the direction of the Y axis is a hub 53 that is slidable on a shaft 54. The axis of the shaft 54 is parallel to the X axis. The hub 53 and the shaft 54 are movable in unison with the frame 50 in directions parallel to the Y axis in response to actuations of the motor 38. Connected to the hub 53 and mounted for movement therewith in directions parallel to the X axis is a rack 56 that is in mesh with a gear 58. The gear 58 is splined to the shaft 36 so as to be movable along the shaft 36 along its axis and so as to rotate in unison with the shaft 36 in response to actuations of the motor 28. The gear 58 is so connected to the frame 50 so as to be movable in directions parallel to the Y axis in unison with the frame 50. The rotation of the shaft 36 by actuations of the motor 28 causes the gear 58 to rotate and thus reciprocate the rack 56 and the hub 53 along the shaft 54 in directions parallel to the X axis. A T-shaped prong 60 is connected to the frame 50 for movement in unison therewith in directions parallel to the X-axis.

From the foregoing, it can be seen that the prong 60 is movable in the X directions in response to actuations of the motor 28 and is movable in the Y directions in response to actuations of the motor 38.

Figure 3:
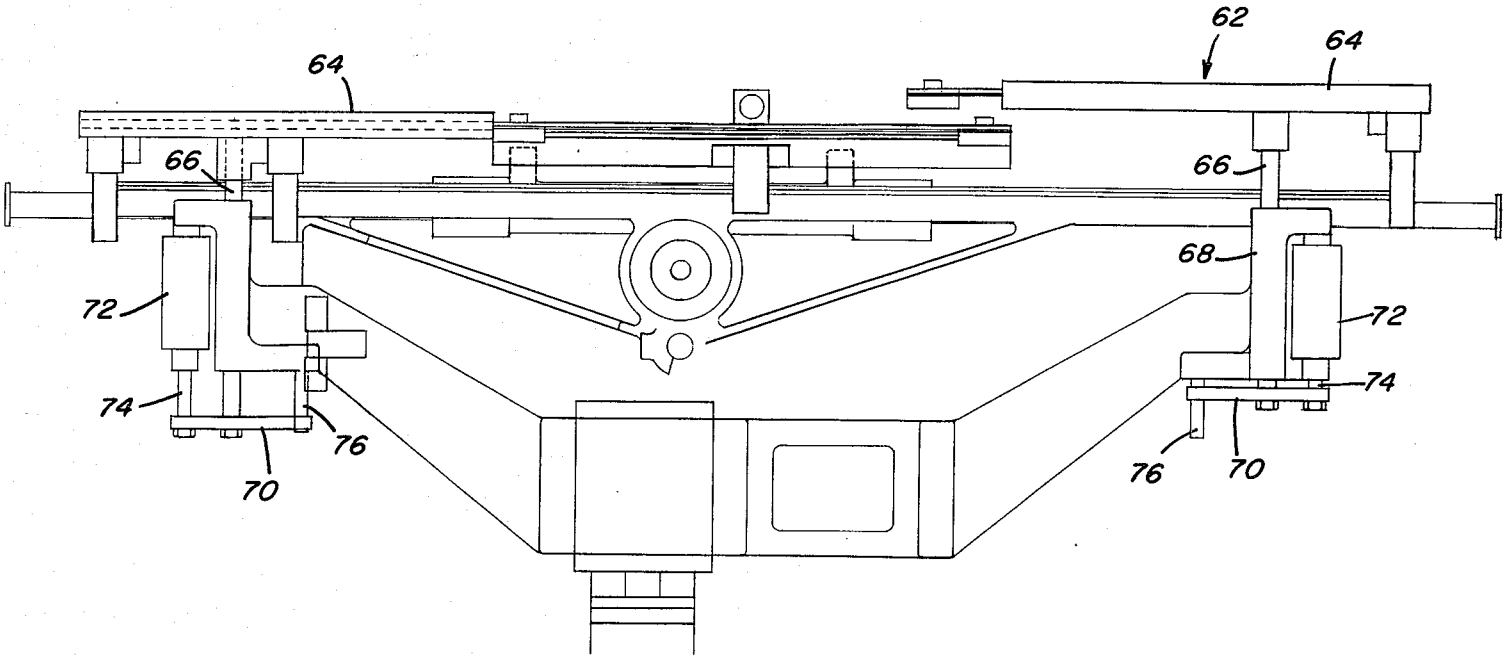
FIG. 3 is a view taken on the line 3—3 of FIG. 2.

As shown in FIGS. 1–3, an elevating arrangement 62 is located on each side of the sewing mechanism 10 at the front of the machine. Referring to FIGS. 2 and 3, each arrangement 62 includes a plate 64 that is mounted for heightwise movement by means of a rod 66 that depends from the plate 64 through a stationary housing 68. The bottom of the rod 66 is attached to a stationary housing plate 70. A pneumatic motor 72, attached to and extending downwardly of the housing 68, has a downwardly extending piston rod 74 that is secured to the plate 70 whereby actuations of the motor 72 effect heightwise movements of the plate 70 to thereby effect heightwise movements of the rod 66 and the plate 64. A pin 76 is secured to and extends downwardly of the housing 68 through an opening in the plate 70 to thereby guide the movements of the rod 66 and the plate 64 in vertical planes.

An air operated pneumatic motor 110 (FIG. 2), attached to a stationary part of the machine, has an upwardly extending piston rod 112 to which is attached a support 114 which is located spacedly from its associated plate 64 and is adapted to support the end of the frame 24 remote from the plate 64.

Referring to FIG. 2, the front of each plate 64 has a cut-out 78 that receives the front of a frame 24. The frame 24 is retained in the cut-out 78 by a plurality of pneumatic motors 80 having upwardly extending piston rods 82 having pins 84 that extend through aligned holes in the plate 64 on opposite sides of the cut-out 78 and holes in the frame 24 in response to such actuations of the motors 80 so as to move the piston rod 82 upwardly.

Figure 5:
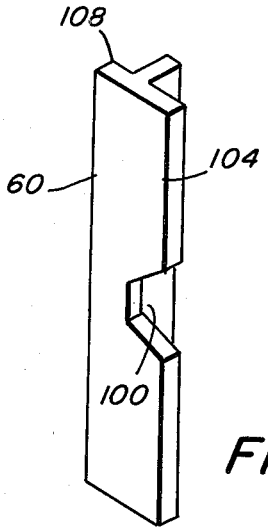
FIG. 5 is an isometric view of a portion of the shifting means.
Figure 4:
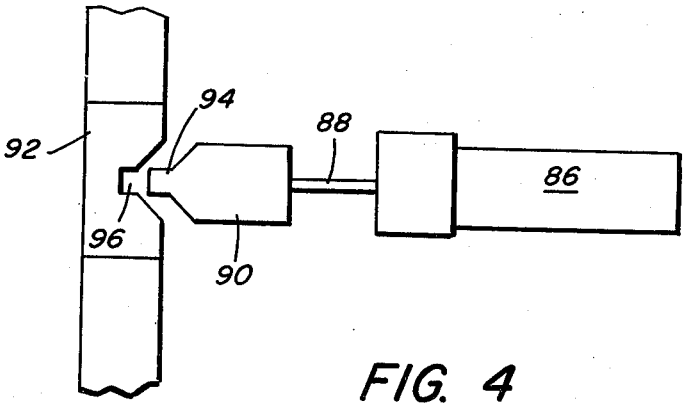
FIG. 4 is a view taken on the line 4—4 of FIG. 2.

Referring still to FIG. 2, and also to FIG. 4, a pneumatic motor 86 is anchored to the frame 24. The piston rod 88 of the motor 86 is secured to a bracket 90 that is slidable on the top of the frame 24. The bracket 90 is movable by the motor 86 towards and away from a bracket 92 that is secured to the top of the frame 24. The brakcet 90 extends downwardly of the frame 24 through an opening in the frame 24. The top of the bracket 90, above the frame 24, is formed into a projection 94 that mates with a recess 96 in the bracket 92 in response to projection of the piston rod 88 out of the motor 86. The bottom 98 of the bracket 90 below the frame 24 is movable into a recess 100 in the prong 60 with the remainder of the bracket bottom 98 (see FIG. 5) being shaped to slidably receive the right leg 104 (FIGS. 2 and 5) of the prong 60. A bracket 106 is secured to the bottom of the frame 24 beneath the bracket 92 and is shaped so as to slidably receive the left leg 108 (FIGS. 2 and 5) of the prong 60.

In the idle condition of the machine: the needle 16 is in an upper position spaced from the throat plate and is stationary; a pair of workpieces 22 are each mounted in a frame 24 and are clamped therein by the clamps 26 so that the workpieces straddle the spaces between the frame sides; the X-Y drive mechanism is so conditioned that the prong 60 is located at the front of the machine between the work elevating arrangements 62; the piston rods 74 are retracted into the motors 72 to thereby elevate the work elevating arrangements 62 to upper positions; the piston rods 82 are projected out of the motors 80 so that the pins 84 project through the aligned holes in the plates 64 and the frames 24 to thereby enable the frames 24 and the workpieces 22 to partake of the heightwise movements of the work elevating arrangements 62 and thus maintain the workpieces 22 in elevated positions that are outward of the needle 16; the piston rods 88 are retracted into the motors 86 to thereby disengage the bracket bottoms 98 from the prong legs 104; and the piston rods 112 are projected out of the motors 110 to maintain the supports 114 in upper positions and thus assist in supporting the frames 24 in their upper positions.

In the operation of the machine, workpieces 22 are alternately presented in position to be stitched from the two sides of the machine on opposite sides of the needle 16. By way of example, a first workpiece 22 on the right side of the machine, as seen in FIG. 3, is the first to be stitched. In order to accomplish this, the associated motor 72, is actuated to project its piston rod 74 and thus lower the associated plate 64 and the associated motor 110 is actuated to retract its piston rod 112 and thus lower associated support 114 to such a lower level that portions of the associated frame 24 and workpiece 22 are supported on the throat plate 18. In this lowering movement, the associated bracket bottom 98 and bracket 106 are brought into substantial registry with the prong 60. After this, the motor 28 is actuated to move the frame 50 and the prong 60 in the direction of the associated work elevating arrangement 62 in an X direction until the prong legs 104 and 108 are slidably received between the associated bracket bottom 98 and bracket 106. After this, the associated motor 86 is actuated to project its piston rod 88 to thus cause the associated projection 94 to engage the associated recess 96 in the associated bracket 92 and cause the associated bracket bottom 98 to engage the recess 100 in the prong 60 thereby locking the associated frame 24 and workpiece 22 for movement in the X and Y directions in unison with the prong 60. At about the same time, the associated motors 80 are actuated to lower the associated piston rods 82 and pins 84 to thereby disengage the associated frame 24 from the associated work elevating arrangement 62.

The X-Y drive mechanism is now operated to move the prong 60 and the workpiece 22 to a position where the starting point of the pattern to be stitched in the workpiece 22 is in alignment with the needle 16 and the opening in the throat plate 18 with at least a part of the frame 24 resting on the throat plate 18. This is followed by a concurrent reciprocation of the needle 16 and operation of the X-Y drive mechanism to move the prong 60 and the workpiece 22 in directions such as to enable the desired pattern of decorative stitches in the workpiece 22 to be applied by the needle 16. When this pattern has been completed, the needle 16 stops its reciprocation in its upper position disengaged from the workpiece 22 and the X-Y drive mechanism causes the workpiece 22 to return to its position wherein the bracket bottom 98 and the bracket 106 are in the positions they had assumed when the motor 86 caused the frame 24 to be locked to the prong 60. After this, the frame 24 is disconnected from the X-Y drive mechanism by the actuation of the motor 86 to retract its piston rod 88 and the frame 24 with the workpiece 22 having the pattern stitched on it is again connected to the work elevating arrangement 62 by actuation of the motors 80 to project piston rods 82 and thus raise their pins 84 into engagement with the frame 24. This is followed by an actuation of the motors 72 and 110 to raise the work elevating arrangement 62, together with its associated frame 24 and workpiece 22, to its upper idle position.

After the right side (FIG. 3) has commenced its rise, the second workpiece 22 on the second side (the left side in FIG. 3) of the machine is operated in the manner described above and is stitched. In order to do this, the sequence of operations described above with respect to the first workpiece are repeated with differences in the movements of those machine parts that are necessitated by the different locations of the first and second work elevating arrangements 62. For example, the frame 50 and the prong 60 are caused to move in the opposite X direction from that direction that placed the prong legs 106 and 108 between the bracket bottom 98 and the bracket 106 of the first frame 24 in order to place the prong legs 104 and 108 between the bracket bottom 98 and the bracket 106 of the second frame 24.

While the second workpiece 22 is being stitched in a lowered position, the first stitched workpiece is in an elevated position on its work elevating arrangement so that the two workpieces will be in different planes and will not intersect each other during the stitching of the second workpiece. At this time, while the second workpiece is being stitched, the motors 80 are actuated to release the first frame 24 from the first right side (FIG. 2) work elevating arrangement, the first stitched workpiece 22 is released by the clamps 26 from the first frame 24 and a new workpiece 22 is attached by the clamps 26 to the first frame 24 after which the first frame 24 is attached to the first work elevating arrangement by the operation of the associated motors 80.

The aforementioned operations are repeated with workpieces 22 being alternately presented from opposite sides of the sewing mechanism to the needle 16 for movement in the X and Y directions to stitch the patterns in the workpieces with a stitched workpiece 22 on one side of the sewing mechanism 10 being removed from its frame 24 while a workpiece 22 emanating from the other side of the sewing machine is stitched while being mounted to its frame 24. The movements of the parts are controlled by signals emanating from the aforementioned tape that signals firmware and software to control the operations of the machine parts as described above.

There follows a recapitulation of the descriptions of those parts of the machine and its mode of operation that are particularly germane to this invention.

The invention is an improvement on or is to be used in conjunction with a prior art machine for performing a prescribed pattern of work on successive workpieces 22. The machine comprises a work station that includes an operating mechanism 10 having an operating instrumentality in the form of the needle 16 that is actuable to perform the work; a plurality of workpiece assemblies that are each formed of a workpiece mount in the form of a frame 24 having a workpiece 22 detachably secured thereto by the clamps 26; a shifting means in the form of the X-Y drive mechanism so constructed as to be actuable to shift a workpiece assembly in a prone plane in a prescribed path past the work station while the operating instrumentality 16 is actuated to enable the operating instrumentality to perform a pattern of work on the workpiece of the workpiece assembly that corresponds to said prescribed path.

The invention is concerned wit a method of presenting to and withdrawing from the work station successive workpiece assemblies to enable the pattern of work to be performed on successive workpieces while they are at the work station and a workpiece handling means for carrying out the method. The invention comprises: a first and second workpiece elevating mechanism 62 located on each side of the work station; each elevating mechanism having releasable retaining means 84 for releasably retaining a workpiece assembly thereon; elevating means 72 associated with each elevating mechanism for moving each elevating mechanism heightwise between a lower position and an upper position; an attaching arrangement 86, 88, 90, 92, 94, 96, 98, 100, 104, 106, 108 for releasably attaching each workpiece assembly to the shifting means while the workpiece assembly is retained on its associated elevating mechanism with the elevating mechanism in its lower position.

In the operation of this invention, a first workpiece assembly and a second workpiece assembly are respectively retained on the first and second elevating mechanism by the retaining means 84 while the elevating mechanisms are in their upper positions; the first elevating mechanism is then lowered to its lower position with the shifting means in position to be located proximate to the lowered position of the first workpiece assembly. The first workpiece assembly is then released by the retaining means 84 from the first elevating mechanism and is attached by the attaching arrangement to the shifting means. The shifting means is then caused to move the first workpiece assembly to the work station and then move the first workpiece assembly through said prescribed path while the operating instrumentality is actuated; the operating instrumentality is then deactuated and the shifting means is caused to return the first workpiece assembly proximate to the first elevating mechanism in its lowered position. The attaching arrangement then causes the first workpiece assembly to be unattached from the shifting means and the retaining means 84 are caused to again retain the first workpiece assembly on the first elevating mechanism. The first elevating mechanism is then returned to its upper position by its elevating means 72, the first workpiece assembly is then released by the retaining means 84 and the retaining means 84 are caused to retain a third workpiece assembly on the first elevating mechanism. After the first elevating mechanism has commenced to be returned to its upper position, the second elevating mechanism, the second workpiece assembly, the shifting means, and the operating instrumentality are caused to repeat the steps and the relative movements referred to above with respect to the first elevating mechanism and the first workpiece assembly.

Since the workpiece assembly that is having work performed thereon by the operating instrumentality is located by the shifting means in a lower plane than the workpiece assembly that is in the process of being retained or removed from one of the elevating mechanisms, there is no interference between the workpiece assembly being worked on and the preceding workpiece assembly that has been worked on or the succeeding workpiece assembly that is to be worked on.

The shifting means is so constructed as to shift the workpiece assemblies in X and Y directions that respectively extend transversely and longitudinally of the operating mechanism 10. Cooperative guide means on the workpiece mounts (98, 106) and on the shifting means (104, 108) guide the shifting means in the X directions to thereby locate the shifting means proximate to the lowered position of each elevating mechanism in position to enable the workpiece assemblies to be in attaching or unattaching relationship with respect to the shifting means and the elevating mechanisms.

We claim:

1. A machine for performing a prescribed pattern of work on successive workpieces comprising: a work station that includes an operating mechanism having an operating instrumentality actuable to perform the work; a plurality of workpiece assemblies, each formed of a workpiece mount having a workpiece detachably secured thereto; shifting means so constructed as to be actuable to shift a workpiece assembly in a prone plane in a prescribed path past the work station while the operating instrumentality is actuated to enable the operating instrumentality to perform a pattern of work on the workpiece of the workpiece assembly that corresponds to said prescribed path; and workpiece assembly handling means for presenting to and withdrawing from the work station successive workpiece assemblies to enable the pattern of work to be performed on the successive workpieces while they are at the work station, characterized in that the workpiece assembly handling means comprises; a first and a second workpiece assembly elevating mechanism located on each side of the work station, each work elevating mechanism having releasable retaining means for releasably retaining a workpiece assembly thereon; elevating means associated with each elevating mechanism for moving each elevating mechanism heightwise between a lower position and an upper position; and an attaching arrangement for releasably attaching each workpiece assembly to the shifting means while the workpiece assembly is retained on its associated elevating mechanism with the associated elevating mechanism in its lower position; whereby a first workpiece assembly and a second workpiece assembly are respectively retained on the first and the second elevating mechanisms while the elevating mechanisms are in their upper positions; the first elevating mechanism is then lowered to its lower position with the shifting means in position to be located proximate to the lowered position of the first workpiece assembly; the first workpiece assembly is then released from the first elevating mechanism and is attached to the shifting means; the shifting means is then caused to move the first workpiece assembly to the work station and then move the first workpiece assembly through said prescribed path while the operating instrumentality is actuated; the operating instrumentality is then deactuated and the shifting means is caused to return the first workpiece assembly proximate to the first elevating mechanism in its lowered position; the first workpiece assembly is then unattached from the shifting means and is again retained on the first elevating mechanism; the first elevating mechanism is then returned by its elevating means to its uper position where the first workpiece assembly is released therefrom and a third workpiece assembly may be retained thereon; and, after the first elevating mechanism has commenced its rise to its upper position, the second elevating mechanism, the second workpiece assembly, the shifting means, and the operating instrumentality are caused to repeat the steps and the relative movements referred to above with respect to the first elevating mechanism and the first workpiece assembly.

2. The machine of claim 1 wherein the shifting means is so constructed as to shift the workpiece assemblies in X and Y directions that respectively extend transversely and longitudinally of the operating mechanism; characterized in further comprising cooperative guide means on the workpiece mounts and on the shifting means to guide the shifting means in the X directions to thereby locate the shifting means proximate to the lowered position of each elevating mechanism in position to enable the workpiece assemblies to be in attaching or unattaching relationship with respect to the shifting means and the elevating mechanisms.

3. For use with a machine for performing a prescribed pattern of work on successive workpieces, the machine comprising: a work station that includes an operating instrumentality actuable to perform the work on a plurality of workpiece assemblies that are each formed of a workpiece mount having a workpiece detachably secured thereto; and shifting means so constructed as to be actuable to shift a workpiece assembly in a prone plane in a prescribed path past the work station while the operating instrumentality is actuated to perform a pattern of work on the workpiece that corresponds to said prescribed path; a method of presenting to and withdrawing from the work station successive workpiece assemblies to enable the pattern of work to be performed on successive workpieces while they are at the work station comprising: providing a first and a second workpiece assembly elevating mechanism located on each side of the work station, each elevating mechanism being movable between a lower position and an upper position; retaining a first workpiece assembly and a second workpiece assembly respectively on the first and the second elevating mechanisms while the elevating mechanisms are in their upper positions; lowering the first elevating mechanism to its lower position with the shifting means in position to be located proximate to the lowered position of the first workpiece assembly; then releasing the first workpiece assembly from the first elevating mechanism and attaching the first workpiece assembly to the shifting means; then causing the shifting means to move the first workpiece assembly to the work station and then move the first workpiece assembly through said prescribed path while the operating instrumentality is actuated; then deactuating the operating instrumentality and causing the shifting means to return the first workpiece assembly proximate to the first elevating mechanism in its lowered position; then unattaching the first workpiece assembly from the shifting means and again retaining the first workpiece assembly on the first elevating mechanism; then returning the first elevating mechanism to its upper position, releasing the first workpiece assembly from the first elevating mechanism and retaining a third workpiece assembly on the first elevating mechanism; and, after the first elevating mechanism has commenced to return to its upper position, causing the second elevating mechanism, the second workpiece assembly, the shifting means, and the operating instrumentality to repeat the steps and the relative movements referred to above with respect to the first elevating mechanism and the first workpiece assembly.

* * * * *